US006203403B1

(12) United States Patent
Odstrcil et al.

(10) Patent No.: US 6,203,403 B1
(45) Date of Patent: Mar. 20, 2001

(54) METHOD OF POLISHING STAINLESS STEEL LAMINATE PRESS PLATES TO A NONDIRECTIONAL FINISH

(75) Inventors: Glenn L. Odstrcil, Rogers; Richard L. Ayala, Temple, both of TX (US)

(73) Assignee: Premark RWP Holdings, Inc., Wilmington, DE (US)

( * ) Notice: Subject to any disclaimer, the term of this patent is extended or adjusted under 35 U.S.C. 154(b) by 0 days.

(21) Appl. No.: 09/428,469

(22) Filed: Oct. 28, 1999

(51) Int. Cl.[7] ..... B24B 1/00
(52) U.S. Cl. ..... 451/28; 451/36
(58) Field of Search ..... 451/28, 41, 36; 72/53; 29/90.1; 76/107.1; 428/452, 352, 454, 481, 482, 483, 487, 503, 511, 515; 427/411; 260/856, 22 CB, 21

(56) References Cited

U.S. PATENT DOCUMENTS 4,117,198 * 9/1978 Power et al. ..... 428/452
4,505,974 * 3/1985 Hosler ..... 428/329
5,596,912 * 1/1997 Laurence et al. ..... 76/107.1

OTHER PUBLICATIONS

3M Web Page, Trizact Structured Abrasives for Casting and Forgings, 1998.
3M Web Page, Trizact Abrasives, 1998.
3M Web Page, Trizact Glass Repair System, 1998 3M Web Page, Trizact Film, 1998.
3M Web Page, Trizact Film, 1998.

* cited by examiner

*Primary Examiner*—Derris H. Banks
(74) *Attorney, Agent, or Firm*—Aquilino, Welsh & Flacxman

(57) ABSTRACT

The method for polishing stainless steel laminate press plates to produce a nondirectional, high gloss surface is achieved by initially preparing a laminate press plate for subsequent polishing and polishing the stainless steel plate in a water slurry with at least one polishing pad comprising precisely shaped pyramids containing micron graded mineral. The resulting laminate press plate is then used in the manufacture of a decorative laminate manufactured by stacking a plurality of synthetic resin impregnated paper sheets, placing the resin impregnated paper sheets between laminate press plates to produce a laminate stack and heating the laminate stack to temperatures for a time sufficient to consolidate the laminate and cure the resins.

35 Claims, 1 Drawing Sheet

METHOD OF POLISHING STAINLESS STEEL LAMINATE PRESS PLATES TO A NONDIRECTIONAL FINISH

BACKGROUND OF THE INVENTION

1. Field of the Invention

The invention relates to a method for polishing stainless steel press plates used in the manufacture of decorative laminates. More particularly, the invention relates to the manufacture of nondirectional stainless steel press plates and the decorative laminates made using the fabricated nondirectional steel press plates.

2. Description of the Prior Art

Stainless steel press plates are commonly used in the manufacture of decorative laminates. The steel press plates sandwich a pair of decorative laminate stacks with the decorative surfaces facing the steel press plates. In this way, the steel press plates impart a desired texture and gloss to the decorative laminates as they are pressed in a conventional manner.

Where it is desired to impart a rough texture to a decorative laminate, the surface of the steel press plate is roughed up, for example, by shot peening the steel press plate prior to use in the fabrication of the decorative laminate. Where a high gloss decorative laminate is desired, the steel press plate is polished until it resembles a mirror.

While various techniques are known for polishing steel press plates in this way, most techniques fail to produce a nondirectional finish on the steel press plate. That is, the resulting polished steel press plate includes distinct lines running in the polishing direction. These lines are clearly noticeable to those skilled in the art and negatively effect the finish of the steel press plates. The lines ultimately effect the final appearance of decorative laminates manufactured using the polished steel press plates.

Specifically, the distinct lines vary the gloss appearance of the steel press plate as the polished steel press plate is viewed from various angles. As with the polished steel press plates, decorative laminates manufactured using the directional polished press plates exhibit distinct and different gloss characteristics when view from various angles. This is undesirable.

Various techniques are known for producing nondirectional press plates. However, these techniques are highly involved and require the use of physically and environmentally hazardous chemicals to achieve desired results. For example, steel press plates are first spindle ground using 80, 100, 120, 150, 180, 200 and 280 grit sanding paper in various combinations depending upon the condition of the press plate at the beginning of the polishing process. The plate is then prepolished with Ursula Rath GmbH red (2015) and blue (3208) polishing pastes. The plate is polished for 45 minutes at approximately 50 AMP pressure with each of the pastes. During the course of this treatment, the plate is treated three times with the red paste and three times with the blue paste. The edges of the plate are then treated to remove any imperfections and the plate is cleaned with a degreasing powder.

Pure beef fat and green paste (Unipol 239) are then alternately applied for 35–40 minutes at approximately 15 AMPS. Final polishing is completed with a compound call "Langsol". Langsol should never be applied directly on the plate, but is put on the machine table and absorbed with the buffers. The Langsol is then used to polish the plate while hardly touching the surface of the plate (15 AMP pressure).

The plate is then treated again with a degreasing powder to remove any grease left over from the treating compounds.

While the process described above does produce a desirable nondirectional steel press plate, the process requires many steps and is highly time consuming. More importantly, the treatment process uses a variety of highly caustic polishing compounds. The disposal of these compounds is highly regulated, and there is a movement to ban the use of such compounds in industrial processing.

As a result, a need exists for a polishing technique to produce nondirectional steel press plates used in the manufacture of decorative laminates. The technique must be relatively simple and eliminate the need for hazardous polishing compounds. The present invention provides such a technique, as well as steel press plates and the decorative laminates produced in accordance with the present technique.

SUMMARY OF THE INVENTION

It is, therefore, an object of the present invention to provide a method for polishing stainless steel laminate press plates to produce a nondirectional, high gloss surface. The method is achieved by initially preparing a laminate press plate for subsequent polishing and polishing the stainless steel plate in a water slurry with at least one polishing pad comprising precisely shaped pyramids containing micron graded mineral.

It is also an object of the present invention to provide a laminate press plate manufactured in accordance with the method described above.

It is a further object of the present invention to provide a decorative laminate manufactured by stacking a plurality of synthetic resin impregnated paper sheets, placing the resin impregnated paper sheets between laminate press plates to produce a laminate stack and heating the laminate stack to temperatures for a time sufficient to consolidate the laminate and cure the resins, wherein the laminate press plates are manufactured in accordance with the method described above.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
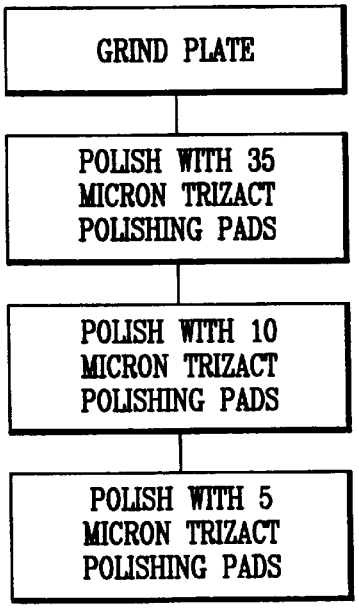
FIG. 1 is a flow chart of the process used in accordance with the present invention.

With reference to FIG. 1, the present process for polishing stainless steel press plates to produce a nondirectional finish is disclosed. In accordance with the preferred embodiment of the present invention, stainless steel press plates used in the manufacture of decorative laminates are polished to produce a nondirectional finish. The nondirectional finish of the press plates ultimately improves the appearance of the resulting decorative laminates.

The stainless steel press plates are preferably 410 grade stainless steel, 304 grade stainless steel or Bohler 630 stainless steel, although a wide variety of plate materials may be used without departing from the spirit of the present invention. The raw steel from which the press plates are fabricated is initially prepared for subsequent polishing in accordance with the present invention. Initial preparation may include, but is not limited to, cutting, shaping, sizing and grinding stainless steel sheets purchased for use in accordance with the present invention.

In accordance with a preferred embodiment of the present invention, the plates are purchased in sizes appropriate for the fabrication of laminate press plates. The plates are commonly cut in a variety of sizes depending upon the specific application for which the plate is destined. For example, plates currently used come in 38", 50" and 62" widths, 7', 8', 10', and 12' lengths and 0.085"–0.250" thicknesses. While specific dimensions are disclosed in accordance with the preferred embodiments of the present invention, the stainless steel press plate may take a variety of forms without departing from the spirit of the present invention.

A desired size stainless steel press plate is first wet ground to produce a desired thickness and surface consistency. It has been found that a dual step grinding process results in an ideal stainless steel press plate ready for further processing. Specifically, the plate is first wet ground with 60-micron paper. The plate is treated with six passes using the 60-micron paper, wherein each pass takes approximately 5 minutes. The stainless steel press plate is then wet ground with 40-micron paper. The plate is once again treated with six passes using the 40-micron paper, wherein each pass takes approximately 5 minutes.

The resulting plate should exhibit a smooth consistent surface. The grinding produces a directional surface consistency undesirable for producing many high gloss laminates.

In accordance with the preferred embodiment of the present invention, an IMEAS wet grinder is used for the initial grinding step, although other grinding machines, and techniques, may be used without departing from the spirit of the present invention. In fact, the necessity for the initial grinding will vary greatly depending upon the initial condition of the press plates requiring polishing.

Figure 2:
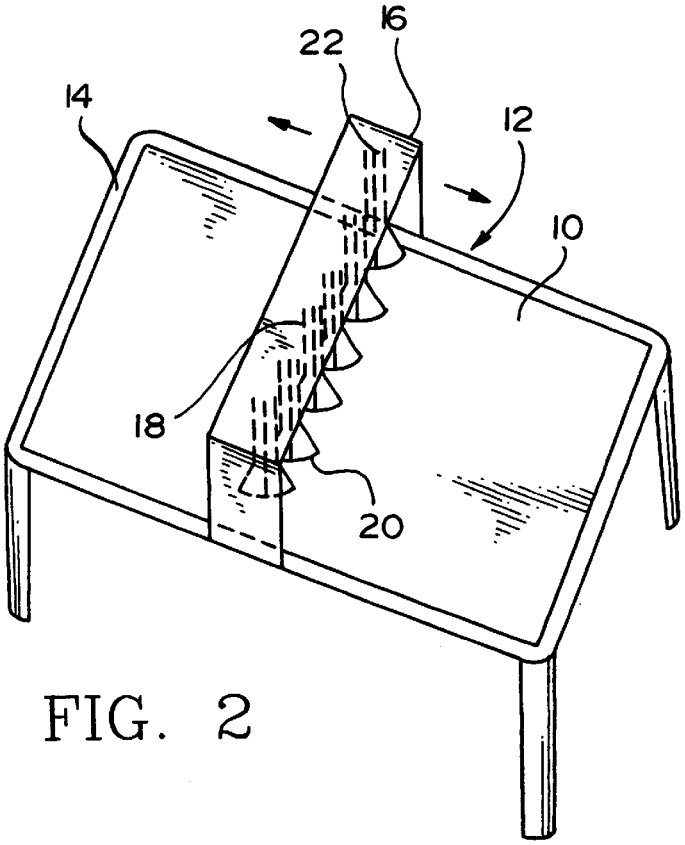
FIG. 2 is a perspective view of the buffer used in accordance with the present invention.

Once the stainless steel press plate is properly ground, the plate 10 is ready for polishing and is transferred to a wet buffer machine 12 (see FIG. 2). In accordance with the preferred embodiment of the present invention, the wet buffer machine 12 is an IMEAS buffer. However, those skilled in the art will readily appreciate that various buffer machines may be used without departing from the spirit of the present invention.

Figure 3:
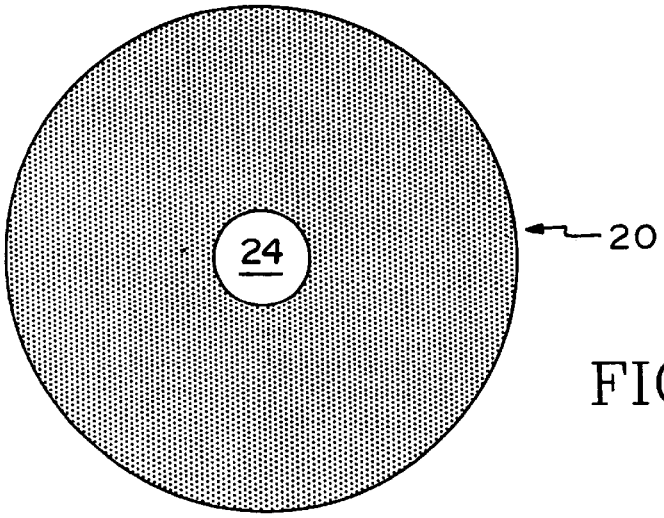
FIG. 3 is a top plan view of the TRIZACT® polishing pads.

Briefly, the buffer machine 12 includes a support surface 14 upon which the stainless steel press plate 10 is positioned for treatment. The buffer machine 12 further includes a carriage 16 which moves a plurality (for example, 6–14) of rotary support members 18 above the surface being treated. The rotary support members 18 are designed for selective coupling to polishing pads 20 (see FIG. 3) which ultimately treat the surface of the stainless steel press plate 10. In accordance with a preferred embodiment of the present invention, each rotary support member 18 includes a coupling surface which is approximately 8 inches in diameter and is designed to support an 8 inch diameter polishing pad 20.

While specific dimensions are disclosed in accordance with a preferred embodiment of the present invention, pads and supports of other sizes may be used without departing from the spirit of the present invention. The rotary support members 18 are further provided with fluid passageways 22 permitting the passage of fluid to the polishing surface as the stainless steel press plates 10 are treated in accordance with the present invention.

The polishing pads 20 are TRIZACT® polishing pads manufactured by 3M® Company. 3M® TRIZACT® polishing pads consist of precisely shaped pyramids containing a micron graded mineral. In accordance with the present invention, the mineral is $AlO_2$, although other materials may be used without departing from the spirit of the present invention. As the abrasive is used, the tops of the pyramids wear away, continually exposing fresh abrasive. This ensures a consistent cut rate through the long life of the TRIZACT® polishing pads.

In accordance with a preferred embodiment of the present invention, and with reference to FIG. 1, the polishing procedure begins by first treating the stainless steel press plates with 35 micron TRIZACT® polishing pads (i.e., green color coded polishing pads). The polishing pads are secured to the rotary support members and applied to the stainless steel press plate. In accordance with the preferred embodiment of the present invention, the backing of the polishing pads permits a hook and loop type attachment to the rotary support member, wherein the water used in conjunction with the polishing does not adversely effect the attachment of the polishing pads to the rotary support members. However, as those skilled in the art will readily appreciate, various techniques may be employed for securing the polishing pads to the rotary support members without departing from the spirit of the present invention.

The rotary polishing members, and ultimately the polishing pads, are rotated at a speed of approximately 1 rpm–1, 500 rpm, and preferably a speed of 100 rpm to 600 rpm, with a flow of water sufficient to maintain an adequate slurry on the plate being polished. The linear travel speed of carriage may be set from between 2 inches/minute to 60 inches/per minute depending upon the rotary speed of the polishing pads and the material being treated.

In accordance with the preferred embodiment of the present invention, the polishing pads make 4 complete passes across the stainless steel press plate. Movement of the polishing carriage is controlled by a conventional control mechanism which ensures accurate application of the polishing pads. In accordance with the preferred embodiment of the invention, the polishing pads are rotated at a speed of approximately 100 rpm to approximately 600 rpm and move at a linear speed of approximately 24 inches/minute to approximately 48 inches/minute. The speeds disclosed above are merely exemplary of a preferred embodiment and may be varied without departing from the spirit of the present invention.

The 35 micron TRIZACT® polishing pads are then removed and the stainless steel press plate is treated in a similar manner with finer 10 micron TRIZACT® polishing pads (i.e., blue color coded polishing pads). The polishing pads are rotated within the range of speeds discussed above with a flow of water sufficient to maintain a slurry on the plate. In accordance with a preferred embodiment of the present invention, the polishing pads make 4 complete passes across the stainless steel press plate. In accordance with a preferred embodiment of the invention, the polishing pads are rotated at a speed of approximately 100 rpm to approximately 600 rpm and move at a linear speed of approximately 24 inches/minute to approximately 48 inches/minute. However, the speeds disclosed above are merely exemplary of a preferred embodiment and may be varied without departing from the spirit of the present invention.

The 10 micron TRIZACT® polishing pads are then removed and the stainless steel press plate is treated in a similar manner with still finer 5 micron TRIZACT® polishing pads (i.e., orange color coded polishing pads). As with the 35 and 10 micron TRIZACT® polishing pads, the polishing pads are rotated within a desirable range in a water slurry. The polishing pads make 4 passes across the stainless steel press plate. In accordance with the preferred embodiment of the invention, the polishing pads are rotated at a speed of approximately 100 rpm to approximately 600 rpm and move at a linear speed of approximately 24 inches/minute to approximately 48 inches/minute. As discussed above, the speeds disclosed above are merely exemplary of a preferred embodiment and may be varied without departing from the spirit of the present invention.

The treated surface of the stainless steel press plate should now exhibit a high gloss, nondirectional finish ideal for producing high gloss decorative laminates. The opposite side of the stainless steel press plate may now be treated in the same manner to produce a stainless steel press plate exhibiting a highly desirable high gloss finish on both its top and bottom surfaces.

It should be noted that the process described above relates to the treatment of stainless steel press plates which have not yet been treated in accordance with the present invention. It is contemplated that the processing time will be less for reworking (i.e., polishing stainless steel press plates which have been used in the manufacturing process to remove imperfections created as a result of use) stainless steel press plates previously polished in accordance with the present invention. For example, it is estimated that reworking stainless steel press plates previously polished in accordance with the present invention will take substantially less time than discussed above, depending upon the condition of the stainless steel press plate surface after use.

As currently manufactured, the TRIZACT® polishing pads 20 are annular shaped with an outer diameter of approximately 8 inches and a center hole 24 of approximately 1¼ inches. The center hole 24 is positioned adjacent the center of the rotary support members 18 and provides a passage through which the water may be applied from the rotary support members 18 to the stainless steel press plate 10 being treated. Unfortunately the size of the hole creates undesirably swirls in the surface of the stainless steel press plate 10 being treated. The swirls are especially noticeable along the edge of the plate, and these swirls must be removed manually once the process described above is completed.

It has been found that the production of swirls is minimized when the central hole 24 size is minimized. With this in mind, the hole 24 is preferably reduced to a size only slightly larger than that of the opening through which the water is supplied from the rotary support member 18 to the treated surface of the stainless steel press plate 10. For example, the hole 14 may be reduced to a size of approximately ¼" to 1" to improve the polishing of stainless steel press plates 10 in accordance with the disclosed process.

In addition to minimizing the swirls produced along the edge of the stainless steel press plate 10, the reduced hole size 24 also reduces the process time required to polish a stainless steel press plate 10 in accordance with the present invention. Specifically, and as those skilled in the art will readily appreciate, the increased surface area generated by reducing the size of the central hole 24 found in the TRIZACT® polishing pad 20 results in greater surface treatment with the same pad, and, thereby, results in reduced required polishing time.

As discussed throughout the proceeding disclosure, the stainless steel press plates described above are used in the fabrication of high gloss decorative laminates. The process used in manufacturing decorative laminates with stainless steel press plates fabricated in accordance with the present invention is substantially identical to those fabrication processes employed in prior art.

Briefly, and as those skilled in the art will readily appreciate, decorative laminates generally include plural layers of synthetic resin impregnated paper sheets bonded under heat and pressure to form a unitary structure. In normal practice, a decorative laminate sheet assembly, from the bottom up, includes a core of one or more phenolic resin impregnated sheets, above which lies a decorative melamine impregnated sheet. The decorative sheet may be further covered with a melamine impregnated overlay.

The core, or base, functions to impart rigidity to the laminate and usually includes a solid substrate which may, or may not, be formed prior to the initial laminating steps. Prior to stacking, the sheets of the core member are impregnated with a water alcohol solution of phenol formaldehyde, dried and partially cured in a hot oven, and finally cut into shapes.

The core may, for example, include a plurality of sheets of 90–150 pound phenolic resin impregnated kraft paper and a substrate. The kraft paper is impregnated throughout and bonded with a substantially completely cured phenolic resin which has been converted to a thermoset state during the initial laminating step. The substrate may be a pre-cured plastic laminate, such as glass fiber-reinforced thermoset polyester resin laminates and the like, a wood product, such as hardboard, wood waste or particle boards, plywood and the like, a mineral base board, such as, cement-asbestos board, sheet rock, plaster board, and the like, or a combination of substrates.

The decorative sheet provides the laminate with an attractive appearance. The decorative sheet also dictates the surface characteristics of the decorative laminate. For example, the composition of the decorative sheet dictates the decorative laminate's resistance to chemical agents, heat, light, shock and abrasion. Decorative sheets are commonly manufactured from high quality 50–125 ream weight, pigment filled, alpha cellulose paper impregnated with a water alcohol solution of melamine formaldehyde resin. The resin impregnated decorative sheets are subsequently dried, partially cured, and finally cut into sheets. The pigment filled, alpha cellulose paper of the decorative sheet, may include a solid color, a decorative design, or a photo-gravure reproduction of natural materials, such as, wood, marble, leather, etc. The aesthetic characteristics of the cellulose paper are revealed as the laminate's decorative design upon completion of the decorative laminate.

Decorative laminates are generally manufactured by placing the resin impregnated core and decorative sheet between stainless steel press plates, such as those described above and manufactured in accordance with the present process, and subjecting the laminate stack to temperatures in the range of about 800–1600 psi for a time sufficient to consolidate the laminate and cure the resins (generally about 25 minutes to an hour). The pressure and heat force the resin in the paper sheets to flow, cure and consolidate the sheets into a unitary laminated mass referred to in the art as a decorative high pressure laminate. Finally, the formed decorative laminate is bonded to a reinforcing substrate, such as, plywood, hardboard, asbestos board, particle board or the like.

Generally, more than one laminate is formed at one time. Multiple laminates are formed by inserting a plurality of assembled sheets in a stack. Release sheets are positioned between the assembled sheets to separate the various laminates stacked together. After consolidation, the release sheets allow the individual laminates to be separated.

While the preferred embodiments have been shown and described, it will be understood that there is no intent to limit the invention by such disclosure, but rather, is intended to cover all modifications and alternate constructions falling within the spirit and scope of the invention as defined in the appended claims.

What is claimed is:

1. A method for polishing laminate press plates to produce a nondirectional, high gloss surface, comprising:

initially preparing a laminate press plate for subsequent polishing;

polishing the laminate press plate in a water slurry with at least one polishing pad comprising precisely shaped pyramids containing micron graded mineral.

2. The method according to claim 1, wherein the step of polishing includes multiple steps employing successively finer and finer polishing pads.

3. The method according to claim 2, wherein the step of polishing includes a first polishing employing at least one 35-micron polishing pad, a second polishing employing at least one 10-micron polishing pad and a third polishing employing at least one 5-micron polishing pad.

4. The method according to claim 1, wherein the mineral is $AlO_2$.

5. The method according to claim 4, wherein the step of polishing includes multiple steps employing successively finer and finer polishing pads.

6. The method according to claim 1, wherein the at least one polishing pad is rotated at approximately 1 rpm to 1,500 rpm.

7. The method according to claim 1, wherein the plate is polished at a linear rate of approximately 2 inches/minute to 60 inches/minute.

8. The method according to claim 1, wherein the at least one polishing pad is annular shaped with a central hole.

9. The method according to claim 8, wherein the central hole has a diameter of approximately ¼" to 1".

10. The method according to claim 9, wherein the central hole has a diameter of approximately ¼".

11. The method according to claim 1, wherein the laminate press plate is a stainless steel plate.

12. The method according to claim 1, wherein the step of initially preparing includes grinding a laminate press plate to a predetermined surface quality.

13. A laminate press plate manufactured in accordance with the method comprising the following steps:

initially preparing a laminate press plate for subsequent polishing;

polishing the laminate press plate in a water slurry with a polishing pad comprising precisely shaped pyramids containing micron graded mineral.

14. The laminate press plate according to claim 13, wherein the step of polishing includes multiple steps employing successively finer and finer polishing pads.

15. The laminate press plate according to claim 14, wherein the step of polishing includes a first polishing employing at least one 35-micron polishing pad, a second polishing employing at least one 10-micron polishing pad and a third polishing employing at least one 5-micron polishing pad.

16. The laminate press plate according to claim 13, wherein the mineral is $AlO_2$.

17. The laminate press plate according to claim 16, wherein the step of polishing includes multiple steps employing successively finer and finer polishing pads.

18. The laminate press plate according to claim 13, wherein the at least one polishing pad is rotated at approximately 1 rpm to 1,500 rpm.

19. The laminate press plate according to claim 13, wherein the plate is polished at a linear rate of approximately 2 inches/minute to 60 inches/minute.

20. The laminate press plate according to claim 13, wherein the at least one polishing pad is annular shaped with a central hole.

21. The laminate press plate according to claim 20, wherein the central hole has a diameter of approximately ¼" to 1".

22. The laminate press plate according to claim 21, wherein the central hole has a diameter of approximately ¼".

23. The laminate press plate according to claim 13, wherein the laminate press plate is a stainless steel plate.

24. The laminate press plate according to claim 13, wherein the step of initially preparing includes grinding a laminate press plate to a predetermined surface quality.

25. A decorative laminate manufactured in accordance with the method comprising the following steps:

stacking a plurality of synthetic resin impregnated paper sheets;

placing the resin impregnated paper sheets between laminate press plates to produce a laminate stack, wherein the laminate press plates are manufactured in accordance with the method comprising the step of polishing the laminate press plate in a water slurry with a polishing pad comprising precisely shaped pyramids containing micron graded mineral; and heating the laminate stack to temperatures for a time sufficient to consolidate the laminate and cure the resins.

26. The decorative laminate according to claim 25, wherein the step of polishing includes multiple steps employing successively finer and finer polishing pads.

27. The decorative laminate according to claim 26, wherein the step of polishing includes a first polishing employing at least one 35-micron polishing pad, a second polishing employing at least one 10-micron polishing pad and a third polishing employing at least one 5-micron polishing pad.

28. The decorative laminate according to claim 25, wherein the mineral is $AlO_2$.

29. The decorative laminate according to claim 28, wherein the step of polishing includes multiple steps employing successively finer and finer polishing pads.

30. The decorative laminate according to claim 25, wherein the at least one polishing pad is rotated at approximately 1 rpm to 1,500 rpm.

31. The decorative laminate according to claim 25, wherein the plate is polished at a linear rate of approximately 2 inches/minute to 60 inches/minute.

32. The decorative laminate according to claim 25, wherein the at least one polishing pad is annular shaped with a central hole.

33. The decorative laminate according to claim 32, wherein the central hole has a diameter of approximately ¼" to 1".

34. The decorative laminate according to claim 33, wherein the central hole has a diameter of approximately ¼".

35. The decorative laminate according to claim 25, wherein the laminate press plate is a stainless steel plate.

* * * * *

UNITED STATES PATENT AND TRADEMARK OFFICE

CERTIFICATE OF CORRECTION

PATENT NO. : 6,203,403 B1
DATED : March 20, 2001
INVENTOR(S) : Glenn L. Odstrcil and Richard L. Ayala It is certified that error appears in the above-identified patent and that said Letters Patent is hereby corrected as shown below:

Title page,
Item [75] Inventors: replace "Glenn L. Odstrcil, Rogers;" with -- Glenn L. Odstrcil, Temple; -- and replace "Richard L. Ayala, Temple;" with -- Richard L. Ayala, Rogers; --.

Signed and Sealed this

Sixth Day of November, 2001

*Attest:*

Nicholas P. Godici

NICHOLAS P. GODICI
*Acting Director of the United States Patent and Trademark Office*

*Attesting Officer*